US006893551B2

(12) United States Patent
Krishna et al.

(10) Patent No.: US 6,893,551 B2
(45) Date of Patent: May 17, 2005

(54) PROCESS FOR FORMING COATINGS ON METALLIC BODIES AND AN APPARATUS FOR CARRYING OUT THE PROCESS

(75) Inventors: Lingamaneni Rama Krishna, Hyderabad (IN); Alexander Vasilyevich Rybalko, Kishnev (MD); Govindan Sundararajan, Hyderabad (IN)

(73) Assignee: International Advanced Research Centre for Powder Metallurgy and New Materials (ARCI), Hyderabad (IN)

( * ) Notice: Subject to any disclaimer, the term of this patent is extended or adjusted under 35 U.S.C. 154(b) by 343 days.

(21) Appl. No.: 10/210,042

(22) Filed: Aug. 2, 2002

(65) Prior Publication Data

US 2003/0094377 A1 May 22, 2003

(30) Foreign Application Priority Data

Nov. 22, 2001 (IN) ..... 945/MAS/2001

(51) Int. Cl.[7] ..... C25D 9/00; C25D 17/00; C25D 21/12

(52) U.S. Cl. ..... 205/316; 205/82; 205/83; 205/106; 205/107; 205/333; 204/228.6; 204/229.8; 204/230.2; 204/230.5; 204/230.8; 204/237; 204/239

(58) Field of Search ..... 205/316, 82, 83, 205/106, 107, 333; 204/228.6, 229.8, 230.2, 230.5, 230.8, 237, 239

(56) References Cited

U.S. PATENT DOCUMENTS 6,197,178 B1 * 3/2001 Patel et al. ..... 205/107

* cited by examiner

*Primary Examiner*—Robert R. Koehler
(74) *Attorney, Agent, or Firm*—Venable LLP; Catherine M. Voorhees

(57) ABSTRACT

A process for forming oxide based dense ceramic composite coatings on reactive metal and allow bodies involves suspension of at least two reactive metal or alloy bodies in a non-metallic, non-conducting, non-reactive chamber in such a way that it causes either partial or full immersion of the bodies in a continuously circulating electrolyte. Thyristor controlled, modified shaped wave multiphase alternating current power supply is applied across the bodies where in each body is connected to an electrode. Electric current supplied to the bodies is slowly increased to a particular value till the required current density is achieved and the maintained at the same level throughout the process. Visible arcing at the surface of the immersed regions of the bodies is identified when the applied electric potential crosses 60V. Electric potential is further increased gradually to compensate the increasing resistance of the coating. Electrolyte composition is regulated through the changes in pH and conductivity of the electrolytic solution, Thickness of the coating formed on the bodies is monitored by the time for which the electrical power at constant current density is supplied to the bodies. The contains obtained are found to exhibit higher density and excellent wear.

11 Claims, 3 Drawing Sheets

PROCESS FOR FORMING COATINGS ON METALLIC BODIES AND AN APPARATUS FOR CARRYING OUT THE PROCESS

FIELD OF INVENTION

The present invention relates to an improved process for forming coatings on metallic bodies.

The present invention particularly relates to an improved process for producing high density oxide based ceramic composite coatings on metallic substrates. The present invention more particularly relates to an improved process for producing high density oxide based ceramic composite coatings on metallic substrates by electro-thermal and electrochemical oxidation in an aqueous alkaline electrolytic bath. The coatings obtained according to the present invention have improved tribological, electrical, thermal and chemical properties and have excellent wear resistance. The present invention also relates to an apparatus for carrying out the above mentioned process.

BACKGROUND OF THE INVENTION

The metals like Al, Ti, Mg and their alloys are commercially and widely used in the engineering industries like automobile, aerospace, textile, petrochemical and crockery in the form of rods, bars, tubes, sheets, pipes, channels, sections, pulleys, cylinders, pistons etc. Apart from the specific promising properties and commercial availability that these materials have, the main reason for using these materials is its high strength to weight ratio. However, there exists a limitation to use these materials beyond a certain point, the limitation arises from the fact that these materials exhibit poor resistance to wear and tear, chemical attack and heat.

Traditionally, anodizing is employed to obtain coatings on Al-alloys. But the resultant coatings are found to be porous, weekly adherent to the substrate, thereby can not provide high level protection against wear and tear and corrosion. More over, coating deposition rates achieved are also low in the anodizing process.

Thermal spraying techniques like plasma spraying, high velocity oxy fuel spraying, detonation spraying are well developed and widely used by the engineering industry to produce large varieties of metallic, oxide, carbide and nitride based ceramic coatings. These coatings are essentially employed to combat various forms of wear and tear and corrosion thereby to enhance the servie life of the components made of different metals and alloys. However, thermal spray techniques demand a high degree of pre coating and post coating operations which are often cost inductive. Size, shape and complexity in geometry of the engineering components do restrict the applicability of the thermal spray techniques. Moreover, these techniques demand high quality as well as costly powders such as Alumina, Alumina-Titania, Tungsten Carbide-Cobalt, Chromium Carbide-Nickel Chrome prepared by specially developed manufacturing routes such as sol-gel, atomization, fusing, sintering & crushing, chemical reduction and blending. Deposition efficiency of these powders is always much less than 100% thus requiring a special means of unused powder separation from the coating chamber. Since these coating techniques employ spraying of heated powder particles on the relatively cold surfaces, often results in poor metallurgical bonding between the substrate and the coating. These coatings are often characterized by inherent porosity, micro cracks and higher levels of residual stresses which in turn leads to the failure of the coatings in the case of critical applications.

To overcome the above mentioned difficulties and limitations and the present day need for coatings exhibiting improved tribological, electrical, thermal and chemical properties and having higher density and excellent wear resistance research work in the area of developing an improved micro arc oxidation process has gained importance globally.

There exist a good number of patents and publications which deal with the micro arc oxidation processes of aluminum and its alloys. Some relevant literature on prior art micro are processes are referred to below.

According to U.S. Pat. No. 6,197,178, a three phase pure sinusoidal potential of 480V AC electrical power is supplied to aluminium alloy bodies and current densities between 20 and 70 A/dm$^2$ is applied. During the process, current density is maintained by moving the bodies relative to each other. An electrolyte with KOH, $Na_2SiO_3$ and $Na_2O.Al_2O_3.3H_2O$ in the proportion of 2 gram per liter of de-ionized water is used. Temperature of the electrolytic bath is maintained between 25 degree C. and 80 degree C. The coating thickness achieved is reported to be in the range of 100 to 160 microns for a 30 minute processing time on cylindrical samples.

Although the resultant coatings were identified to have strong adherence with the substrate no information is available with respect to the density and uniformity of the coatings achieved. Coating density is very important parameter in deciding the wear resistance of the resulting coatings.

In the invention cited above, the inventors used a pure sinusoidal voltage wave form without any waveform modification, while a sharply peaked-waveform makes a major contribution in providing a dense and hard coating. This is why the coatings obtained through the above mentioned process exhibit lower hardness ie. 1200–1400 kg/mm$^2$.

U.S. Pat. No. 5,616,229 granted to Samsonov et al. discloses a method of forming a ceramic coating on valve metals. This method comprises application of at least 700V alternating current across the parts to be coated. Waveform modification is achieved through a capacitor bank connected in series between high voltage source and the metallic body to be coated. Waveform of the electric current rises from zero to its maximum hight and falls to below 40%. of its maximum height with in less than a quarter of a full alternating cycle.

Electrolyte used in the above cited, process contains 0.5 grams/liter NaOH, 0.5–2 grams/liter KOH. In addition, electrolyte also contains sodium tetra silicate for which there is no claim on the exact amount to be added. During the process, the electrolyte composition is changed by adding oxy acid salt of an alkali metal in the concentration range of 2 to 200 grams per liter of solution. This process has been demonstrated by coating an aluminium alloy known as Duralumin by employing 3 different electrolytic baths.

However, in the processes explained above the applicants did not maintain any particular ratio between the alkali and the metal silicate.

In the micro are oxidation process, alkali is actually responsible for dissolving the coating where as the metal silicate is responsible for coating built up through poly condensation of silicate anions. Too high silicate concentration in the electrolyte causes higher coating built up especially at the sample edges rather than at the other portions of the sample thus resulting in a non-uniform coating. Hence there is a need to maintain a certain degree of proportion between the alkali and metal silicate in order to end up with a uniform and dense coatings.

Further, the process disclosed in the U.S. Pat. No. 5,616,229 has been claimed to have an average deposition rate of 2.5 micron per minute. However, the thickness of fully melted inner layer is only 65 microns out of a total coating thickness of 100 microns. This indicates that this process can produce coatings comprising only 65% initial dense layer and remaining 35% external layer is porous with 4–6 no. of pores per sq.cm. area and an average pore diameter of 8–11 microns.

To make these coatings suitable for wear resistant applications, the external porous layer of sufficient thick needs to be completely removed by machining or grinding. Apart from the fact that these machining or grinding operations are costly, machining/grinding of coated parts of complex, non-symmetric shapes is extremely difficult and demands high degree of automated machinery and higher skill levels also. This effictively increases the cost of the coating per unit volume.

The prior art processes of micro anrc oxidation processes through yielded thick, adherent coatings with higher coating deposition rates but failed to produce dense and uniform layers which are essentially required to impart high hardness, higher wear resistance against abrasion, sliding and erosion wear modes as well as with relatively better surface finish. Also, coatings with higher fraction of inherent porosity will not give satisfactory corrosion resistance and dielectric properties.

Moreover, in the prior art, the process employed for coating metallic bodies has been discussed in detail, but not much has been disclosed about the apparatus used for carrying out the coating process.

According to the invention disclosed in U.S. Pat. No. 6,197,178, the apparatus employed for obtaining the coating consists of a chemically inert coating tank disposed with in an outer tank. The outer tank contains heat exchange fluid. Electrolyte from the inner tank is circulated through the heat exchanger disposed in the outer tank itself. To remove heat from the heat exchange fluid, heat exchange fluid is withdrawn from the outer tank with the help of a pump and then passed through a forced air cooled heat exchanger. The operation of the exchangers was controlled automatically so as to maintain the desired temperature within the electrolyte bath. However, there exists a serious drawback with this kind of setup. When a component of larger size than that of the inner coating tank is to be coated, the dimensions of the inner tank are to be increased which in turn may demand for changing the outer tank dimensions as well. This makes the process more cost inductive.

OBJECTS OF THE INVENTION

An object of this invention is to propose an improved process for micro arc oxidation for obtaining dense, hard, uniform and thick ceramic composite coatings.

Another object of the present invention is to propose an improved process for micro arc oxidation to protect the surface of reactive metals and their alloys, in particular aluminum and its alloy bodies against wear, corrosion and oxidation.

Yet another object of the present invention is to propose an improved process for micro arc oxidation for obtaining coatings on the surfaces of reactive metals and their alloys, in particular aluminum and its alloy bodies by depositing adherent, dense, hard, uniform, impervious coating on their surfaces.

Still another object of the present is to provide an improved process for micro arc oxidation for obtaining coatings on the surfaces of reactive metals and their alloys which is simple and economical.

Another object of the present invention is to propose an apparatus for carrying out the improved process for micro arc oxidation for obtaining coatings on the surfaces of reactive metals and their alloys.

The objects of the present invention are achieved by providing a process involving electro-thermal and electrochemical oxidation of reactive metals and their alloys, in particular aluminum and its alloy bodies in a specially prepared alkaline electrolytic solution whose pH is >12 and conductivity>2 milli mhos. Electrolytic solution is prepared by directly adding the additives while the de-ionized/distilled water is in continuous circulation through the reaction chamber. By this method, the time required to uniform mixing of the additives with the water is reduced, as well as the necessity of mechanical stirrer if the electrolyte is externally prepared is also avoided. An electrolyte reservoir and a heat exchanger is connected in series with the reaction chamber facilitate the processing of larger components with a simple alteration in the reaction chamber dimensions thereby avoiding any other design changes.

BRIEF DESCRIPTION OF THE DRAWINGS

The invention is described in detail in the figures shown in the drawing accompanying this specification. In the drawings

SUMMARY OF THE INVENTION

Figure 3:
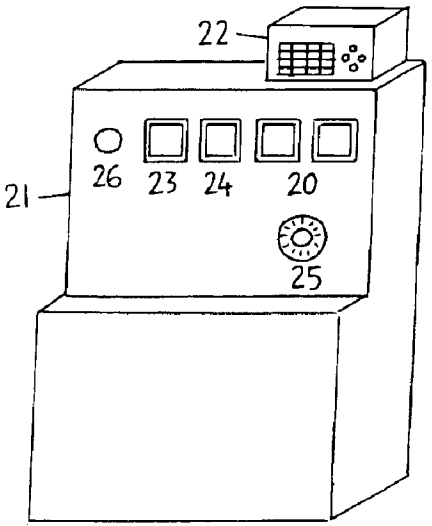
FIG. 3 represents the front view of the remote control panel for carrying out the process of the present invention.

Accordingly, the present invention provides an improved process for forming ceramic composite coatings on bodies of reactive metals and alloys which comprises electrolyzing in a non-metallic, non-reactive, non-conductive reaction chamber (1) containing an alkaline electrolytic solution having a pH>12 and conductivity>2 milli mhos, comprising potassium hydroxide, sodium tetra silicate and de-ionized or distilled water, immersing at least two metallic bodies (2) selected from the reactive group of metals on which coatings have to be effected, the bodies being connected to the electrical power carrying arm (3) in a movable manner, each body being connected to the transformer (17) passing modified wave multiphase alternating current across the said bodies by means of two back-back parallelly connected thyristors (FIG. 5) for a period based on the desired thickness of the coatings to be achieved, slowly increasing the current being supplied to the said bodies till the required current density is achieved, then maintaining the current at the same level throughout the process, the electric potential bring further increased gradually to compensate the increasing resistance of the coating when the visible arcing at the surface of the immersed regions of the said bodies is noticed, regulating the composition of the electrolyte by measuring its pH and conductivity during the process by conventional methods, maintaining the temperature of the electrolyte between the range of 4 and 50 degree C. and keeping the electrolyte in continuous circulation throughout the process.

In a preferred embodiment of the invention the elctrolyte may contain 2–6 grams of potassium hydroxide and 1–3 grams of sodium tetra silicate. The metallic bodies employed may be selected from the reactive group of metals consisting Al, Ti, Mg, Zr, Ta, Be, Ge, Ca, Te, Hf, V and their binary, ternary and multi-constituent alloys with elements like Cu, Zn, Mg, Fe, Cr, Co, Si, Mn, Al, Ti, Mg, Zr, Ta, Be, Ge, Ca, Te, Hf, V, W.

The bodies may be immersed either fully or partially. The duration of the electrolysis is based on the final coating thickness desired for which the electrical power at constant current density is imposed. The rate of circulation of the electrolyte per minute may be at least 10% of the reaction chamber's capacity. The electrolyte may preferably enter the reaction chamber from its bottom, flows upward in the chamber and leaves from the top.

The distance between the said immersed bodies and also the depth of immersion are made adjustable. The modified shaped wave electric current, electric potential peaks are asymmetric, sharp and the anodic electric potential is 2–3 times higher than the cathodic electric potential. Preferably a constant current density of >0.1 A/cm$^2$ may be maintained throughout the electrolytic process. The electric potential may range between 60V to 1500V.

The bodies to be coated are fixed in the reaction chamber in such a manner that they are rotatable either along the axis of its suspension or along the longitude.

Throughout the process, the electrolyte is kept in a continuous circulation around the bodies under coating by means of an electrical pump. Electrolyte entering the non-metallic, non-conductive, non-reactive chamber at the bottom and leaves from the top avoid any gaseous film/envelope formation at the bottom surfaces of the said bodies. A heat exchanger and/or a chiller may be placed externally in the electrolyte flowing circuit so as to control the temperature of the electrolyte at any point between 4 degree C. and 50 degree C. Continuous electrolyte circulation ensures the homogeneity of the electrolyte and also advantageous for effective heat dissipation from the surface of the bodies. This is very important as it avoids the excessive evaporation of the electrolyte due to intense electrical arcing on the sample surface thereby making the process more eco-friendly, In the electrolyte the ratio between the alkali and metal silicate is maintained constant and the composition is regulated by the pH and conductivity of the electrolytic solution measured form time to time during the process.

After immersing the said bodies either partially or fully in the electrolytic solution, a modified waved high voltage alternating current electric power is applied across the bodies. Modification of waveform is achieved by conecting two back-back paralally connected thyristors in series prior to high voltage transformer such that the sultant voltage and current peaks are sharp and non-symmetrical. Anodic electric potential is about 2–3 times higher than the cathodic potential. Electric current is slowly increased to get a current density>0.1 A/cm$^2$ and then maintained at the same level throughout the process. As soon as the applied electric potential crosses 60 V, initial arcing on the surface of the bodies is visible. Further voltage is increased to a maximum of 1500 V to compensate the increase in resistance of the coating thus allowing the current density to be maintained at the same level throughout the process. Depending on the treatment time, required coating thickness is achieved and the supply of electric power supply is stopped.

According to another feature of the present invention there is provided an apparatus for carrying out the process for forming ceramic composite coatings on bodies of reactive metals and alloys which comprises a non-metallic, non-conductive, non-reactive reaction chamber (1) housing at least two metallic bodies (2), the surfaces of which are to be coated, the bodies being connected to the electrical power carrying arm (3) provided with a height adjustable mechanism (37) an inlet (38) for the electrolyte provided at the bottom and an outlet (39) at the top of the chamber, on the panel of main controller (8) analog voltmeter (9) and ammeter (10) being provided to indicate the input voltage and current, a lever type electric power on/off switch (11) being provided, a potentiometer (12) provided for slowly increasing the current supply to the metallic bodies (2), contactor on/off (13), thyristor on/off (14) switches, manual/automatic voltage adjustment (15) and local/remote operation (16) selector switches being also provided, thyristor (not shown) and transformer (17) outputs being connected through the separate analog voltmeters (18) and ammeters (19), two separate digital temperature indicators (20) being attached to the panel of remote controller (21), the temperature of electrolyte at the inlet and outlet being measured through the thermocouples (not shown), an oscilloscope (22) attached to the remote controller (21) for monitoring the electrical potential and current waveforms during the process, digital voltmeter (23) and ammeter (24) attached to the remote control panel (21) being used to monitor the changes in the current and voltage during the coating process, the height of electrolytic column (7) in the reaction chamber (1) being adjusted through a dimmerstat (25) attached to the panel of remote controller (21) and an emergency stop button (26) being attached to the remote control panel (21) for terminating the electrical power supply to the bodies in the case of any emergency.

Figure 4:
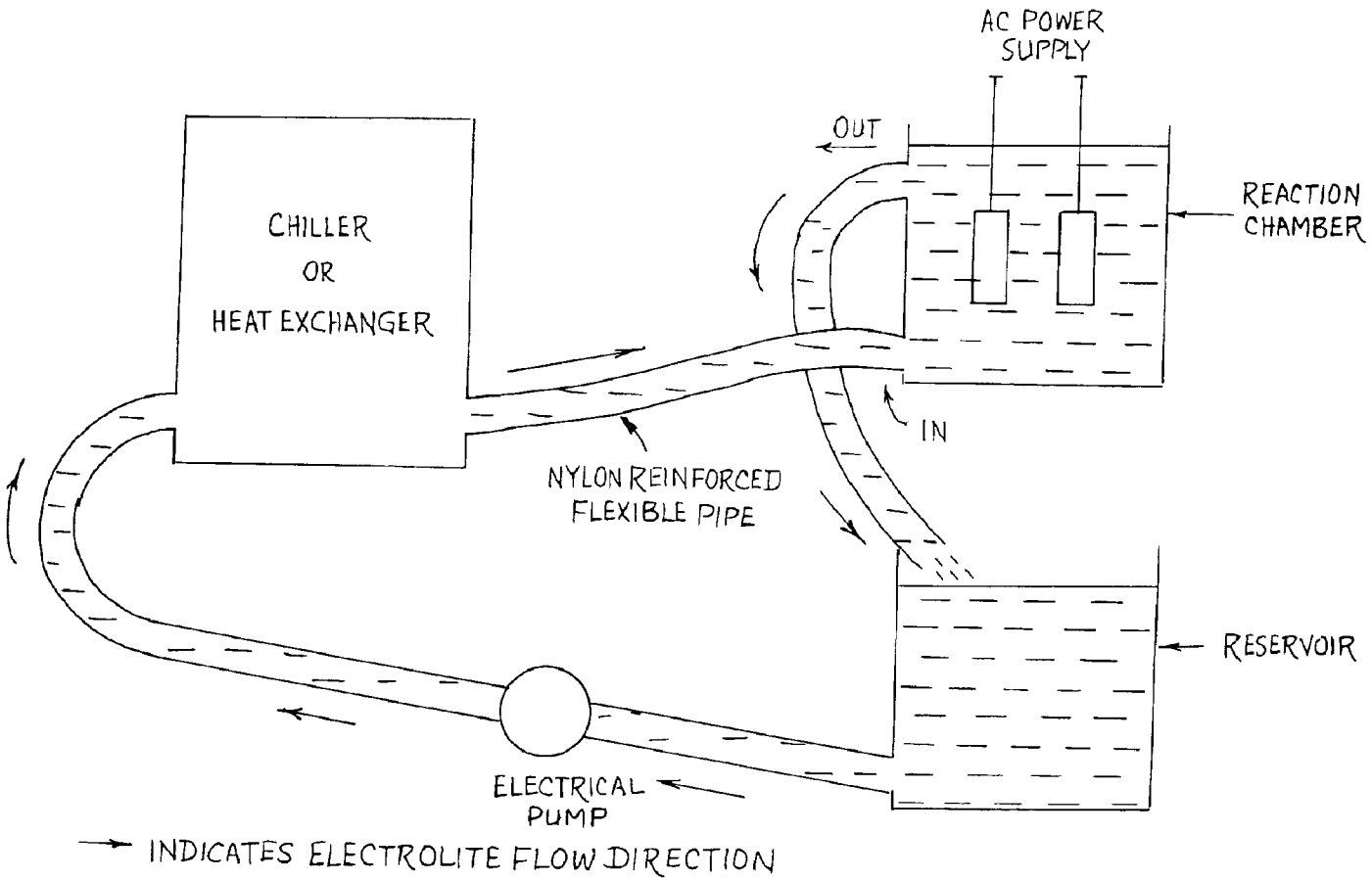
FIG. 4 is a line diagram of the electrolyte flowing circuit employed for carrying out the process of the present invention.

FIG. 4 gives the line diagram of electrolyte circulating during the coating process. Electrolyte in the reservoir is pumped into the chiller (or heat exchanger) and then fed to the reaction chamber. Electrolyte in the reaction chamber raises against the gravity and upon reaching the exit point, flows out through the nylon reinforced flexible pipes and collected into the reservoir. Chiller (pr heat exchanger) is used to control the temperature of the electrolyte at any point between 4 degree C. and 50 degree C.

By carrying out the process as described above it is possible to obtain coatings on the surfaces of reactive metals and their alloys particularly on aluminium and its alloys to a predetermined thickness in few minutes. Porosity in the coatings thus obtained is significantly reduced to negligible levels, formation of external porous layer is completely eliminated, dense and uniform coatings are also achieved through the process according to the present invention. The cost of machining or grinding required to remove the external porous layer is saved. The components prepared by this process can be directly subjected to the wear, corrosion resistant applications. Further the coatings produced by this method are very hard, adherent, smooth, dense and uniform than the coatings produced in the prior art.

DESCRIPTION OF THE INVENTION

Figure 2:
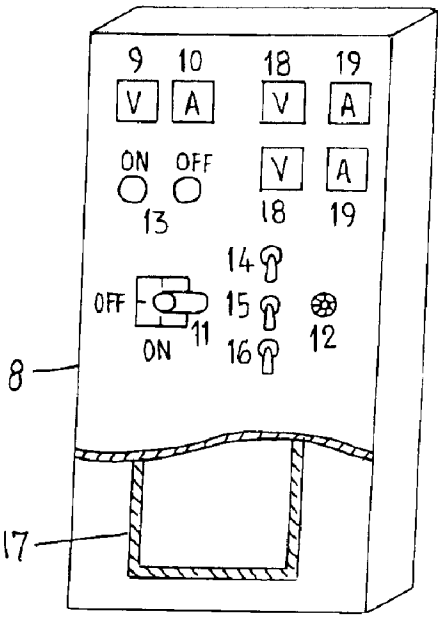
FIG. 2 represents the front view of the main control panel for carrying out the process of the present invention.
Figure 1:
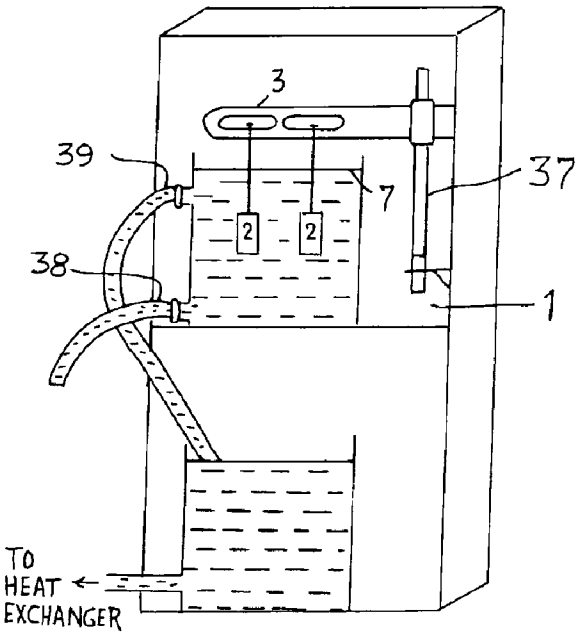
FIG. 1 represents the front view of the coating apparatus for carrying out the process disclosed in the present invention.

As shown in FIG. 1 metallic bodies to be coated (2) are connected to the electrical power carrying arm (3) provided with a height adjustable mechanism (37). Electrolyte is circulated through the non-metallic, non-conductive, non-reactive chamber (1) (named as reaction chamber) in which the bodies (2) to be coated are suspended. Electrolyte enters the reaction chamber (1) from the bottom (38) of the reaction chamber and leaves from the top (39) of the chamber. The height of electrolytic column in the reaction chamber (7) stabilizes within a minute and the switch fuse unit is turned on with the help of a lever connector (11) as shown in FIG. 2. Contactor switch button (13) is pushed on and the electric current fed to the bodies (2) is slowly increased with the help of a potentiometer (10) till the current reaches the required current density level. Thyristor (not shown) and transformer (17) output voltage and currents are noticed through the separate analog voltmeters (18) and ammeters (19) attached to the main control unit (8). Both the inlet and outlet temperatures of the electrolyte circulating through the reaction chamber (1) are measured through two separate digital temperature indicators (20) attached to the panel of remote controller (21) as shown in FIG. 3. An oscilloscope (22) attached to the remote controller is used to monitor the electric potential and current waveform during the process. Digital voltmeter (23) and ammeter (24) attached to the remote control panel (21) is used to monitor the changes in the current and voltage during the coating process. An emergency stop button (26) may also be attached to remote control panel to terminate the electrical power supply to the bodies in the case of any emergency. Glow on the surface of the bodies (2) due to the electric breakdown of the prior formed coating can also be seen from the bodies suspended in the reaction chamber.

FIG. 4 gives the line diagram of electrolyte circulating during the coating process. Electrolyte in the reservoir is pumped into the chiller (or heat exchanger) and then fed to the reaction chamber. Electrolyte in the reaction chamber raises against the gravity and upon reaching the exit point, flows out through the nylon reinformed flexible pipes and collected into the reservoir. Chiller (or heat exchanger) is used to control the temperature of the electrolyte at any point between 4 degree C. and 50 degree C.

Figure 5:
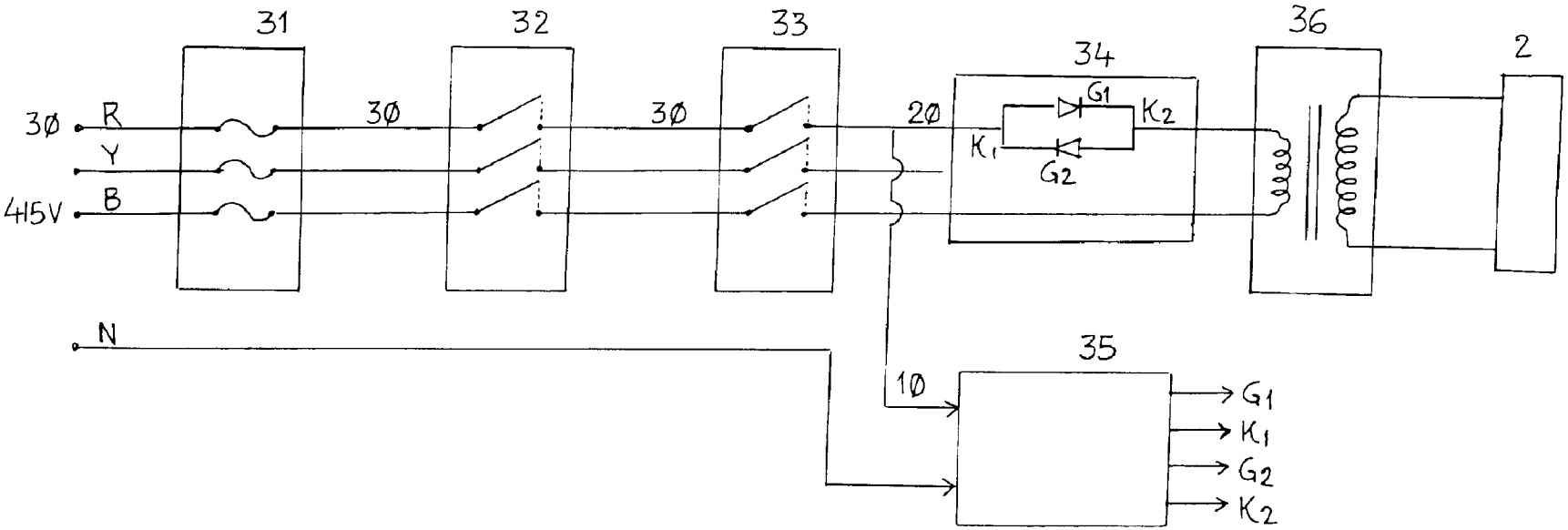
FIG. 5 is a schematic illustration of the electric circuit used in the process of the present invention.

FIG. 5 give the electrical line diagram of the circuit used in carrying out the process of the present invention. A 3-phase alternating current power supply of 425 V is fed to the switch fuse unit (31) containing ON/OFF provision. Upon turning on the switch fuse unit, through the moulded case circuit breaker (32) electrical power enters the contractor (33). The function of moulded case circuit breaker (32) is to trip the power supply in the event of any electrical short circuit. Subsequently one phase of the 3-phase power supply enters the back-back parallelly connected thyristor unit (34). Firing angle and firing frequency of the thyristors ($G_1$, $K_1$, $G_2$, $K_2$) are controlled through a thyristor power controller (35). Output of the thyristors is fed to the high voltage transformer (36) which subsequently feeds the electrical power to the bodies to be coated (2) wherein the resistance of the bodies acts as an electrical load on the transformer. Electrical breakdown of the firstly formed ceramic composite film is visible on the surface of the body in the form of electric arcs. The number and color of electric arcs changes with processing time. Final coating thickness is identified from the time period for which the electrical power is supplied after attaining the required current density. The final voltage shall go up to 1500 V depending on the size of the body and the final coating thickness.

The following examples illustrate the ability of the process described in the present invention.

EXAMPLE 1

Two aluminium 7075 alloy specimens of 10×15×20 mm dimension are connected to the output of the high voltage transformer. The total surface area of each sample is 13 $cm^2$. The current density selected based on a single sample is 0.3 $A/cm^2$. Electrolyte containing 4 grams of potassium hydroxide and 2 grams of sodium tetra silicate per liter of de-ionized water. Electrolyte is allowed to circulate through the reaction chamber throughout the process. Electrolyte temperature is maintained between 4–6 degree C. In order to exercise better control over the kinetics of the coating process, current density is maintained constant throughout the experiment. Voltage increased up to a maximum of 450 V by the end of 60 minute test run time. At the end of 1 hour, electrical power was switched off, samples were taken out, cleaned in fresh running water and dried with warm air. The average coating thickness of the ceramic composite coating formed is measured to be 95 microns and the microhardness is 1800 $Hv_{0.2}$ while the average microhardness of uncoated 7075 alloy is measured to be only 155 $Hv_{0.2}$. Further, the coatings formed are found to have excellent adhesion, high density and uniformity also the coating is fully dense without any extended porous layers.

EXAMPLE 2

Two aluminium 7075 alloy specimens of 75×25×15 mm dimension are immersed in a continuously circulating electrolyte having 3 grams of potassium hydroxide and 1.5 grams of sodium tetra silicate per of de-ionised water. The total surface area of each sample is 67.5 $cm^2$. The current density selected based on a single sample is 0.25 $A/cm^2$, maintained constant throughout the process. Electrical power supply is continuously fed to the samples for a period of 70 minutes, final voltage at the end of the process has reached to 600 V. The average coating thickness and the microhardness measured are 85 microns and 1755 $Hv_{0.2}$ respectively. Coating is found to exhibit a fully dense layer withy very good adhesion to the substrate. These samples are subjected to dry sand abrasion test as per ASTM G65 standard. Steady state abrasive wear loss is measured to be 45 times lower than the uncoated 7075 alloy. This is clearly illustrating the fact that the ceramic composite coatings obtained by the method described in the present invention is resulting in excellent improvement in wear resistance.

It is apparent to a person reasonably skilled in the art that modifications and changes can be made within the spirit and scope of the present invention. Accordingly such modifications and changers are also covered within the scopoe of the present invention.

Advantages of the Invention

1. The coatings obtained by employing the process of the present invention are uniform, dense coatings which are also well bonded with the substrate.
2. There are no porous layers on the coated bodies.
3. The components prepared by the process of the present invention can be directly used for wear, corrosion resistant applications.
4. The porosity in the coatings obtained is significantly reduced to negligibly low levels.
5. The formation of external porous layer is completely eliminated.
6. The cost of machining or grinding required to remove the external porous layer is saved.
7. The components in widely differing sizes and shapes can be treated without much design changes in the apparatus disclosed in the present invention.
8. The coatings produced by the process of the present invention are very hard, adherent, smooth, dense and uniform than the coatings produced by the process hitherto known.

We claim:

1. An improved process for forming ceramic composite coatings on bodies of reactive metals and alloys which comprises:

electrolysing in a non-metallic, non-reactive, non-conductive reaction chamber containing an alkaline electrolytic solution having a pH>12 and conductivity>2 millimhos, comprising potassium hydroxide, sodium tetra silicate and de-ionized or distilled water;

immersing at least two metallic bodies selected from the reactive group of metals on which coatings have to be effected, the bodies being fixed in a movable manner, each body being connected to an electrode;

passing wave multiphase alternating current across the said bodies by means of two back-back parallelly connected thyristors for a period based on the desired thickness of the coatings to be achieved, slowly increasing the current being supplied to the said bodies till the required current density is achieved, then maintaining the current at the same level throughout the process, the electric potential being further increased gradually to compensate the increasing resistance of the coating when the visible arcing at the surface of the immersed regions of the said bodies is noticed;

regulating the composition of the electrolyte by measuring its pH and conductivity during the process by conventional methods, maintaining the temperature of the electrolyte between the range of 4 degree C. to 50 degree C. and keeping the electrolyte in continuous circulation throughout the process.

2. An improved process as claimed in claim 1 wherein the electrolyte contains 2–6 grams of potassium hydroxide and 1–3 grams of sodium tetra silicate.

3. An improved process as claimed in claim 1, wherein the metallic bodies employed are selected from the reactive group of metals consisting of Al, Ti, Mg, Zr, Ta, Be, Ge, Ca, Te, Hf, V and their binary, ternary and multi-constituent alloys with elements like Cu, Zn, Mg, Fe, Cr, Co, Mn, Si, Al, Ti, Mg, Zr, Ta, Be, Ge, Ca, Te, Hf, V, W.

4. An improved process as claimed in claim 1, wherein the bodies are immersed in the electrolyte either fully or partially.

5. An improved process as claimed in claim 1, wherein the duration of the electrolysis is based on the final coating thickness.

6. An improved process as claimed in claim 1, wherein the rate of circulation of the electrolyte per minute is at least 10% of the reaction chamber's capacity.

7. An improved process as claimed in claim 1, wherein the modified shaped wave electric current and electric potential peaks are asymmetric, sharp and the anodic electric potential is 2–3 times higher than the cathodic electric potential.

8. An improved process as claimed in claim 1, wherein a constant current density of >0.1 A/cm$^2$ is maintained throughout the electrolytic process.

9. An improved process as claimed in claim 1, wherein the electric potential used ranges between 60V to 1500V.

10. An improved process as claimed in claim 1 wherein the temperature of the electrolyte is maintained at any point between 4 degree C. and 50 degree C.

11. An apparatus for carrying out the process as claimed in claim 1, comprising:

a non-metallic, non-conductive, non-reactive chamber housing at least two metallic bodies the surfaces of which are to be coated, the bodies being connected to an electrical power carrying arm provided with a height adjustable mechanism;

an inlet for the electrolyte provided at the bottom of the chamber and an outlet at the top of the chamber;

on the panel of main controller, a first analog voltmeter and a first ammeter being provided to indicate the input voltage and current, a lever type electric power on/off switch being provided, a potentiometer provided for slowly increasing the current supply to the metallic bodies, contactor on/off, thyristor on/off switches, manual/automatic voltage adjustment and local/remote operation selector switches being also provided, thyristor and transformer outputs being connected through separate second analog volmeters and ammeters;

two separate digital temperature indicators being attached to the panel of remote controller, the temperature of electrolyte at the inlet and outlet being measured through the thermocouples, an oscilloscope attached to the remote controller for monitoring the electrical potential and current waveforms during the process, a digital voltmeter and an ammeter attached to the remote control panel being used to monitor the changes in the current and voltage during the coating process, the height of electrolytic column in the reaction chamber being adjusted through a dimmerstat attached to the panel of remote controller and an emergency stop button being attached to the remote control panel for terminating the electrical power supply to the bodies in the case of any emergency.

* * * * *